United States Patent [19]

Duerr

[11] 4,130,201

[45] Dec. 19, 1978

[54] SHRINK WRAP CONTAINER PACKAGE

[75] Inventor: Joseph W. Duerr, Rockleigh, N.J.

[73] Assignee: Ganz Brothers, Inc., Bergenfield, N.J.

[21] Appl. No.: 733,695

[22] Filed: Oct. 19, 1976

[51] Int. Cl.[2] ..... B65D 75/06

[52] U.S. Cl. ..... 206/432; 53/398; 229/52 B

[58] Field of Search ..... 206/141, 161, 428, 432, 206/497; 229/DIG. 12

[56] References Cited

U.S. PATENT DOCUMENTS

| | | | |
|---|---|---|---|
| 3,400,810 | 9/1968 | Makowski | 206/161 |
| 3,403,392 | 10/1968 | Becker et al. | 206/432 |
| 3,490,582 | 1/1970 | Farquhar | 206/432 X |
| 3,557,947 | 1/1971 | Greenwell | 206/432 |
| 3,948,392 | 4/1976 | Faust | 206/432 |
| 3,954,177 | 5/1976 | Faust | 206/432 |

*Primary Examiner*—Steven E. Lipman
*Attorney, Agent, or Firm*—Charles E. Brown

[57] ABSTRACT

This disclosure has to do with a bottle package of the type wherein at least four bottles arranged in two columns are formed into a package by wrapping a heat shrinkable plastics material film thereabout and effecting shrinking of that film to tightly grip bottles. In order to facilitate the carrying of the package, finger receiving openings are formed on opposite sides of central ones of the bottles with the film engaged over the top of the central ones of the bottles between the finger receiving openings defining a carrying strap. The shrinking of the film is effected in a shrink tunnel where hot air is directed against the film. The finger receiving openings are formed in the film between adjacent pairs of bottles after initial shrinking of the film has occurred, but before the film reaches the end of the shrink tunnel so that after slitting of the film occurs, there is further shrinking of the film, primarily down between adjacent pairs of bottles. The result is the widening of the slit in the film to define finger receiving openings which are generally oval or elliptical in shape with the periphery edge of each opening being reinforced by the thickening of the film due to shrinkage and wherein a strap is formed tightly about the central bottles, which strap forms a carrying or pick-up strap.

3 Claims, 4 Drawing Figures

FIG. 1
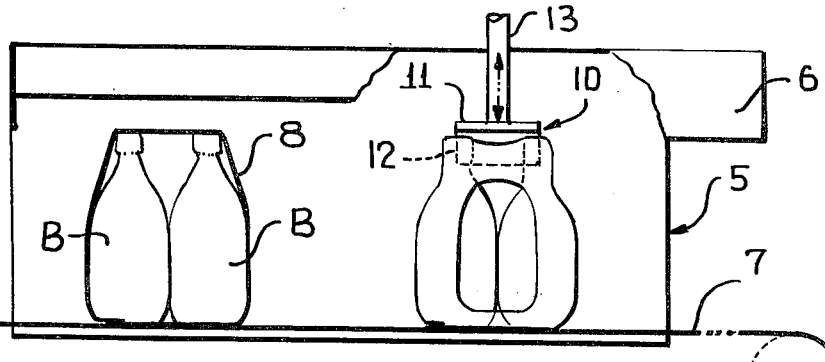
FIG. 2
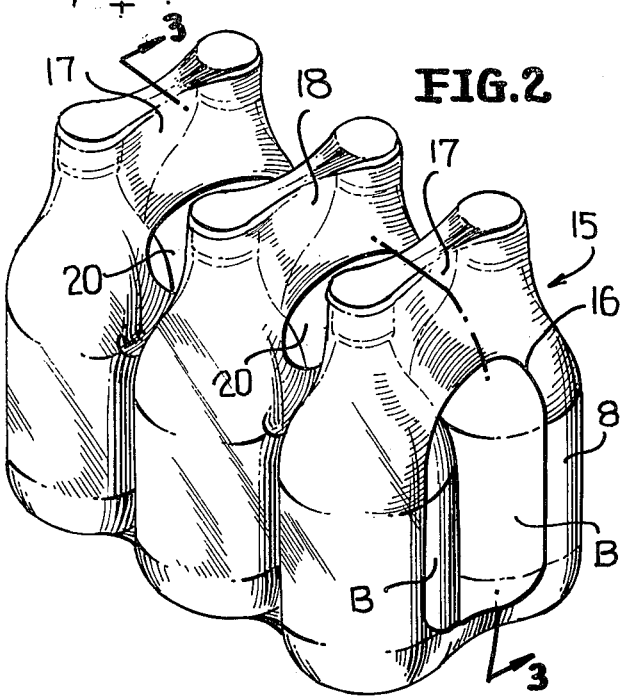
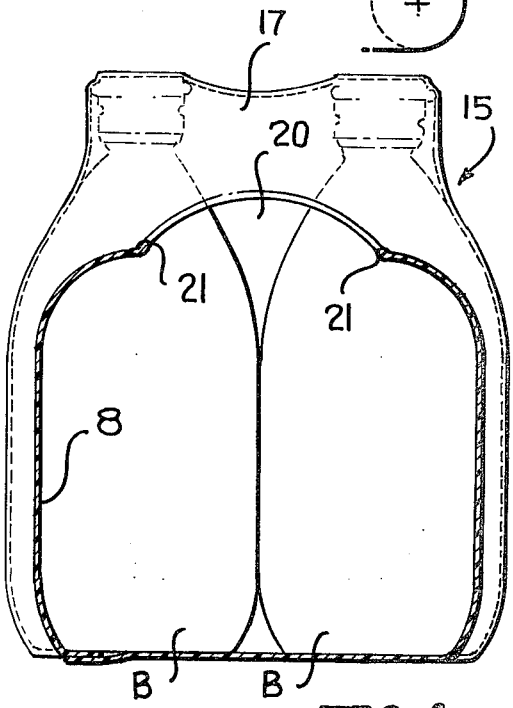
FIG. 4
FIG. 3
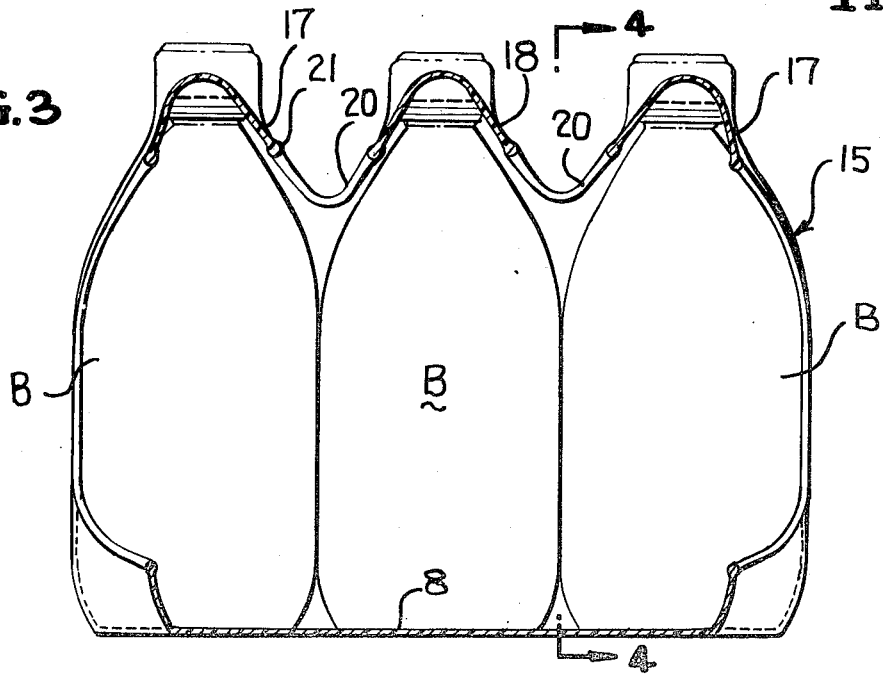

SHRINK WRAP CONTAINER PACKAGE

This invention relates in general to new and useful improvements in container packages, and more particularly to an improved bottle package and the method and apparatus for forming the same.

It is conventional to form packages by arranging a plurality of articles into two columns and at least three rows, and then to wrap such a group of articles with a heat shrinkable plastics material film transversely of the direction of the columns. The so wrapped group of articles is then passed through a shrink tunnel wherein heated air is directed against the film with the resultant shrinking of the film tightly about the articles to effect a very tight package.

The aforedescribed package and the method of forming the same is utilized principally in conjunction with containers such as cans and bottles. It is further conventional with respect to such packages to form slits or openings in the top surface of the film between adjacent pairs of articles to form finger receiving openings. However, prior packages have had certain deficiencies. For example, if the film is slit after the film has been completely shrunk about the articles, the film is subject to ready tearing and thus the package is weakened with often times the film between the finger receiving openings completely rupturing.

In other instances, the film has been slit or ruptured prior to the shrinking thereof. As a result, the film is discontinuous at the time of the heat shrinking thereof about the articles and the resultant package is not a tight package as is required.

In accordance with this invention, it is proposed to form a package which includes a heat shrunk plastics material film wrapping having finger receiving openings therein on opposite sides of the central containers and wherein between the openings the film has tightly shrunk about the containers to define a pick-up or carrying strap and wherein the film, about each of the finger receiving openings is reinforced by the thickening thereof.

In accordance with this invention, it is proposed to pass the articles wrapped with the film into a conventional shrink tunnel and after an initial shrinking of the film has occurred, to slit or rupture the film transversely between adjacent pairs of articles and thereafter to complete the shrinking of the film with the result that at the time the slits are formed in the film, the film has already tightly engaged about the containers and the further heating and shrinking of the film results in the drawing of the film down between adjacent pairs of containers to form a strap overlying the central containers and to effect spreading of the slits longitudinally of the columns of containers so as to have a generally oval or elliptical outline and wherein in the further shrinking of the film, the film about the periphery of the openings is thickened.

With the above and other objects in view that will hereinafter appear, the nature of the invention will be more clearly understood by reference to the following detailed description, the appended claimed subject matter, and the several views illustrated in the accompanying drawing.

IN THE DRAWINGS:

FIG. 1 is a schematic longitudinal sectional view taken through a conventional shrink tunnel having incorporated therein means for slitting or rupturing the film wrapped about a group of containers and being heat shrunk within the tunnel.

FIG. 2 is a top perspective view of a bottle package formed in accordance with this invention.

FIG. 3 is a longitudinal vertical sectional view taken along the line 3—3 of FIG. 2 and shows more specifically details of the bottle package.

FIG. 4 is a transverse vertical sectional view taken along the line 4—4 of FIG. 3.

Referring now to the drawings in detail, it will be seen that there is illustrated in FIG. 1 a conventional shrink tunnel which is generally indicated by the numeral 5. The shrink tunnel 5 is provided with suitable heater means 6 for directing heated air against package groupings passing therethrough for the purpose of heating the heat shrinkable plastics material film to the temperature required for the effective shrinking thereof. Associated with and forming part of the shrink tunnel 5 is an endless conveyor 7. It is to be understood that the endless conveyor 7 receives article groupings which have already been encased in a film wrap 8 from a package forming machine (not shown).

In accordance with this invention, articles to be packaged, such as bottles B, are arranged in two columns and each group of bottles include at least four bottles with six being the preferred number of bottles being packaged although it is feasible that eight bottles or a greater even number of bottles could be packaged together.

A sheet of the film 8 is wrapped around the bottles B in a direction transverse to the column direction and the ends of the sheet of film 8 are overlapped beneath the bottles and suitable bonded together in any conventional manner. The film sheet has a dimension longitudinally of the column of bottles in excess of the length of the column of bottles.

If the wrapped group of bottles were permitted to pass through the shrink tunnel 5 in the normal manner, the film 8 would closely conform to the contour of the lower portions of the bottles along the outer surfaces thereof as exposed in the group and would pull down slightly between the tops of the adjacent bottles. If the film in such a resultant package was then slit transversely of the columns between adjacent pairs of bottles the film would loosen and would have a tendency to tear at the ends of the slits towards one another so that an effective lifting strap could not be formed from the central portion of the film at the top of the package. In a like manner, if the film 8 were slit before the wrapped group of bottles entered into the shrink tunnel 5, there would be a tendency for the film at the top of the package to be transversely divided into three sections which would result in a loose wrap as far as the total four bottles were concerned.

In accordance with this invention, the wrapped group of bottles is permitted to pass sufficiently through the shrink tunnel 5 for the film 8 to effectively shrink about the bottles and form a relatively tight package, but with the shrinking being incomplete. Then at a preselected point in the passage of the wrapped bottle group through the shrink tunnel 5, in accordance with this invention, a slit is formed in the upper portion of the film 8 between each pair of bottles utilizing a slitting device generally identified by the numeral 10. The slitting device 10, in its simpliest form, includes a fixed support plate 11 having depending therefrom at least two slitters 12 which may simply be in the form of heated wires fixed to the support plate. The wires are located at a point in the tunnel where the film at the top area of the package should be fully shrunk and be at a relatively consistent height above the conveyor so as to provide consistency in length of slits as between packages. On the other hand plate 11 may be carried by a suitable carrier 13 for vertical reciprocatory movement so as to rapidly reciprocate in turned relation with the movement of the wrapped bottle groups through the shrink tunnel 5 to assure the operation of the slitter when the wrapped bottle group is properly positioned with respect thereto.

After the slits have been formed in the upper portion of the film between adjacent pairs of bottles, the further travel of the wrapped bottle group through the shrink tunnel 5 will result in the further heating of the film 8 and the shrinking thereof. The net result will be that the film 8 will shrink down in between adjacent pairs of bottles to more tightly grip the upper portions of the bottles. Further, the straight line slit formed between adjacent pairs of bottles will open longitudinally of the column of bottles so as to have a generally oval or elliptical shape. The net result is that the top portions of each pair of bottles will be gripped by strap portions, which will be described in more detail hereinafter, including a central strap portion disposed between the adjacent pair of finger receiving openings, which latter-described strap portion will be a lifting or pick-up strap.

It is also to be understood that during the furthere heating and shrinking of the film 8, the film about the periphery of the resultant finger receiving openings will thicken so as to be self-reinforcing.

Referring now to FIGS. 2–4, it will be seen that the resultant bottle package is clearly shown, the package being identified by the numeral 15. As described above, the bottle package 15 normally includes six bottles B. The film 8 will tightly fit the lower cylindrical portions of the bottles and will pull in between adjacent bottles a limited degree, as is clearly shown in FIG. 4. Further, the film at the opposite ends of the sheet of film will shrink inwardly longitudinally of the columns of bottles so as to fit about the remote end surfaces of the end bottles leaving a generally oval opening 16 at each end of the bottle package.

It is to be understood that the aforedescribed bottle package is conventional as thus described.

The bottle package 15 distinguishes from conventional bottle packages, however, in that the film 8, after it has shrunk tightly about the group of bottles, has been relieved by the formation of the two transverse slits therein and is now free to draw down between the adjacent pairs of bottles so as to form the aforedescribed straps. It will be apparent from FIG. 3 that the aforedescribed straps include a pair of endmost straps 17 which engage over the top portions of the endmost bottles B, and a central strap 18 which is engaged over the central bottles. While the strap 18 has been illustrated as being engaged over a pair of bottles, it is to be understood that if there were eight bottles in the package, the strap 18 could extend over two pairs of bottles.

It will also be readily apparent from FIG. 3, in particular, that the further shrinking of the film and the formation of the straps 17 and 18 has resulted in a spreading of the originally formed slit in the film longitudinally of the columns of bottles to define relatively wide finger receiving openings 20. Thus the strap 18 becomes available as a strap which may be gripped so as to facilitate the picking-up and carrying of the bottle package.

Finally, because of the further heat treatment and shrinkage of the film subsequent to the forming of the slits therein,the periphery of each finger receiving opening 20 is defined by a thickened cross-section 21 of the film, which thickened cross-section serves as a self-reinforcement of the film.

From the foregoing, it will be apparent that by effecting the slitting of the film 8 at a particularly specified time during the heat treatment and shrinkage of the film, the desired tight pack is formed and at the same time the film overlying the upper portions of the bottles is free to shrink down in between the bottles to define both straps and finger receiving openings. Thus a tight package, as is required, is formed while at the same time the lifting strap 18 is provided. Finally, the usual tearing of the film at the ends of the finger receiving openings formed therein is eliminated both by the generally oval or elliptical configuration of the openings and the reinforcing of the openings by the thickened edges 21.

Although a preferred embodiment of the invention has been specifically illustrated and described herein, it is to be understood that minor variations may be made in the invention without departing from the spirit and scope of the invention as defined by the appended claims.

I claim:

1. A package comprising a plurality of containers each having a base portion and a tapering neck portion, said containers being arranged in two columns and including at least three rows, a sheet of heat shrinkable plastics material film defining a sleeve extending about said containers and open at its ends in the direction of said columns, said sheet being heat shrunk about said containers and tightly fitting about said containers with portions of said sheet enclosing said containers at the ends of said package and defining end openings of limited size as compared to the cross-section of said package, and a slit in said sheet in the direction of said rows between adjacent pairs of rows, said sheet being relieved solely by said slits with each slit having been transformed to a heat shrunk finger receiving opening generally oval in plan between adjacent ones of said rows with said sheet extending inwardly and downwardly about said container tapering neck portions to define a strap of inverted U-section encasing the tapering neck portions of the two containers in the respective row, said straps including a strap tightly engaging upper portions of at least two centrally disposed ones of said containers and defining a lifting strap, said straps each extending in the direction of said rows and extending in about three quadrants of each container tapering neck portion.

2. A package according to claim 1 wherein said film about the periphery of each of said finger receiving openings is thickened as opposed to the nominal thickness of said film, the thickening of said film together with the tightness of said film around said containers being evidence of the forming of said finger receiving openings subsequent to certain shrinking of the film around said containers and prior to the termination of the shrinking of said film.

3. A package according to claim 1 wherein said containers are bottles.

* * * * *